US007328487B2

(12) United States Patent
Hoffman et al.

(10) Patent No.: US 7,328,487 B2
(45) Date of Patent: Feb. 12, 2008

(54) BUNDLING SYSTEM WITH IMPROVED LOCKING TIE HEAD

(75) Inventors: Richard A. Hoffman, Landenberg, PA (US); Murray J. Bordeaux, Elizabethtown, NC (US); William R. Sessoms, Lumberton, NC (US); Rodney L. Thompson, St. Pauls, NC (US); Stephen D. Horton, Bladenboro, NC (US)

(73) Assignee: Dymetrol Company, Inc., Hockessin, DE (US)

( * ) Notice: Subject to any disclaimer, the term of this patent is extended or adjusted under 35 U.S.C. 154(b) by 119 days.

(21) Appl. No.: 11/290,743

(22) Filed: Nov. 30, 2005

(65) Prior Publication Data

US 2007/0119030 A1 May 31, 2007

(51) Int. Cl.
*B65D 63/00* (2006.01)
*B65D 33/00* (2006.01)

(52) U.S. Cl. ..... 24/16 PB; 24/17 AP

(58) Field of Classification Search ..... 24/712.1, 24/712.2, 712.4, 712.5, 712.6, 30.5 R
See application file for complete search history.

(56) References Cited

U.S. PATENT DOCUMENTS

| | | | | |
|---|---|---|---|---|
| 3,875,618 | A * | 4/1975 | Schuplin | 24/16 PB |
| 4,422,217 | A * | 12/1983 | Barrette | 24/16 R |
| 4,993,669 | A * | 2/1991 | Dyer | 248/61 |
| 5,102,075 | A * | 4/1992 | Dyer | 248/61 |
| 5,121,524 | A * | 6/1992 | Mortensen | 24/16 PB |
| 5,193,251 | A * | 3/1993 | Fortsch | 24/16 PB |
| 5,544,391 | A * | 8/1996 | Hoffman | 24/16 PB |
| 6,473,942 | B1 * | 11/2002 | Caveney et al. | 24/16 PB |
| 6,532,631 | B2 * | 3/2003 | Rohaly et al. | 24/16 PB |
| 2006/0242800 | A1 * | 11/2006 | Pettersson | 24/16 PB |

* cited by examiner

*Primary Examiner*—Robert J. Sandy
(74) *Attorney, Agent, or Firm*—Brian A. Gomez; Gomez International Patent Office, LLC

(57) ABSTRACT

A bundling system with improved locking tie head comprising a smooth planar strap and a locking head with two flexible independent L-shaped pawls. One end of the pawl is anchored in the locking head. The locking head has two transverse pawl cavities allowing flexural movement of the pawl during insertion of the planar strap and locking engagement to prevent withdrawal of the strap.

17 Claims, 6 Drawing Sheets

BUNDLING SYSTEM WITH IMPROVED LOCKING TIE HEAD

BACKGROUND OF THE INVENTION

Bundling ties have been used extensively for securing objects, such as utility lines. Bundling systems often comprise a tie head and strapping material that is wrapped around the items to secure and then inserted through passageways in the tie head. Two approaches include a one-piece unit that combines the tie head with a fixed length of strapping material. A second approach includes a two-piece system with a tie head and strapping material that can be cut to the desired length. The present invention deals with the two-piece bundling system.

U.S. Pat. No. 5,544,391 to Hoffman utilizes a one-piece V-shaped pawl pivotally mounted within the housing for engagement with a strap. A similar solution can be found in U.S. Pat. No. 6,128,809 to Khokhar, which teaches a one-piece locking device with two barbs for independent deflectable locking engagement with strapping material. However, these solutions have certain limitations associated with the design including distortion of the locking device and ultimate failure of the head under high load conditions.

A second focus has been on the configuration and implementation of the locking device within the tie head housing. The shape of the locking device as well as the engagement edge has been addressed in order to provide a more secure engagement with the strapping. For example, U.S. Pat. No. 6,532,631 to Rohaly teaches a flat T-shaped locking device with a beveled knife-edge. The T design, however, is susceptible to failure as the narrow portion of the device can distort and fail under heavier loads. In addition, the beveled knife-edge can cut through a significant portion of the strap material under heavier loads or slide along the strap causing premature failure of the head.

A further attempt to improve engagement with a strap without destroying the integrity of the strap under load is covered in U.S. Pat. No. 5,193,251 to Fortsch. Fortsch teaches a bundling tie employing a pair of movably supported locking barbs, with each barb having an engagement portion comprising a knife-like element for biting insertion into the strap and a blunt stop wall adjacent to the knife-like element for limiting the depth of insertion of the knife-like element into the strap.

While each of the above designs provides certain benefits, there has been a continuing effort directed to improving the performance of bundling ties including the ease of use, reliability and longevity of the tie as well as the ability to securely bundle multiple items in high stress environments with little, if any, slippage of the strap. The present invention overcomes the above limitations and provides a simple, lightweight and cost effective solution that combines an elegant design with superior performance.

SUMMARY OF INVENTION

The present invention is a bundling system with an improved locking tie head, that is lightweight, easy to use and that provides superior locking engagement.

Specifically, the present invention provides bundling tie system comprising:

(a) a separate smooth planar strap having a first end and a second end;

(b) a locking tie head having a first aperture and a second aperture with an inlet and an outlet for unidirectional insertion of the first and second strap ends, a central dividing wall between the first and second apertures, and a first and second pawl cavity transverse to the first and second apertures; and (c) first and second independent flexible L-shaped pawls anchored in the first and second transverse pawl cavity with a first leg and a second leg, longer than the first leg, with the first leg having a mounting end and the second having an engagement end, with the mounting end fixedly anchored in the locking head, and the engagement end having two or more teeth, partially extending into the first and second aperture for locking engagement with the planar strap;

wherein the transverse pawl cavities allow flexural movement of the engagement end of the pawl during the insertion of the planar strap and then locking engagement to prevent withdrawal of the strap.

The bundling system of the instant invention further provides a vertical column of material in the first and second transverse pawl cavity for providing a pushpin stop. The bundling system further provides a locking head comprising one or more breakaway pins for anchoring the first and second pawls in the locking tie head.

DETAILED DESCRIPTION OF THE INVENTION

The bundling tie of the present invention comprises a locking head with two vertical apertures separated by a central dividing wall. The vertical apertures are designed for unidirectional insertion of a smooth planar strap. The locking head further comprises two transverse pawl cavities running the width of the locking head and separated by the central dividing wall. Anchored within and centered in of each of the transverse cavities is a flexible L-shaped pawl.

The locking head can be prepared from various materials including thermoplastic and thermoset resins. Polyamides and polyacetals have been found to be particularly satisfactory. Polyamides which can be used include nylon 6, nylon 66, nylon 610 and nylon 612 molding resins. Polyacetals have been found to be particularly satisfactory for the construction of the locking heads of the present invention.

Figure 1:
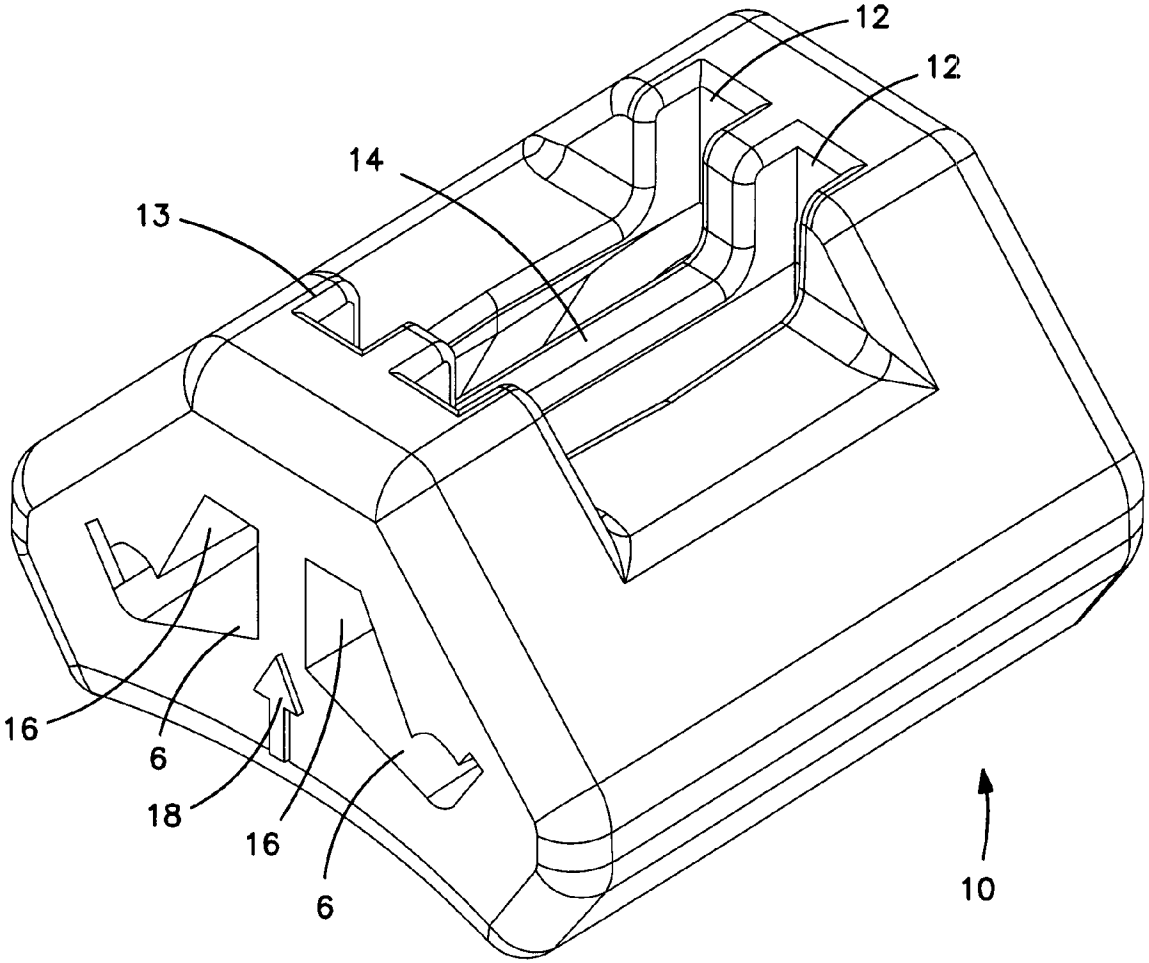
FIG. 1 is a side elevational view of the locking head of the present invention.
Figure 2:
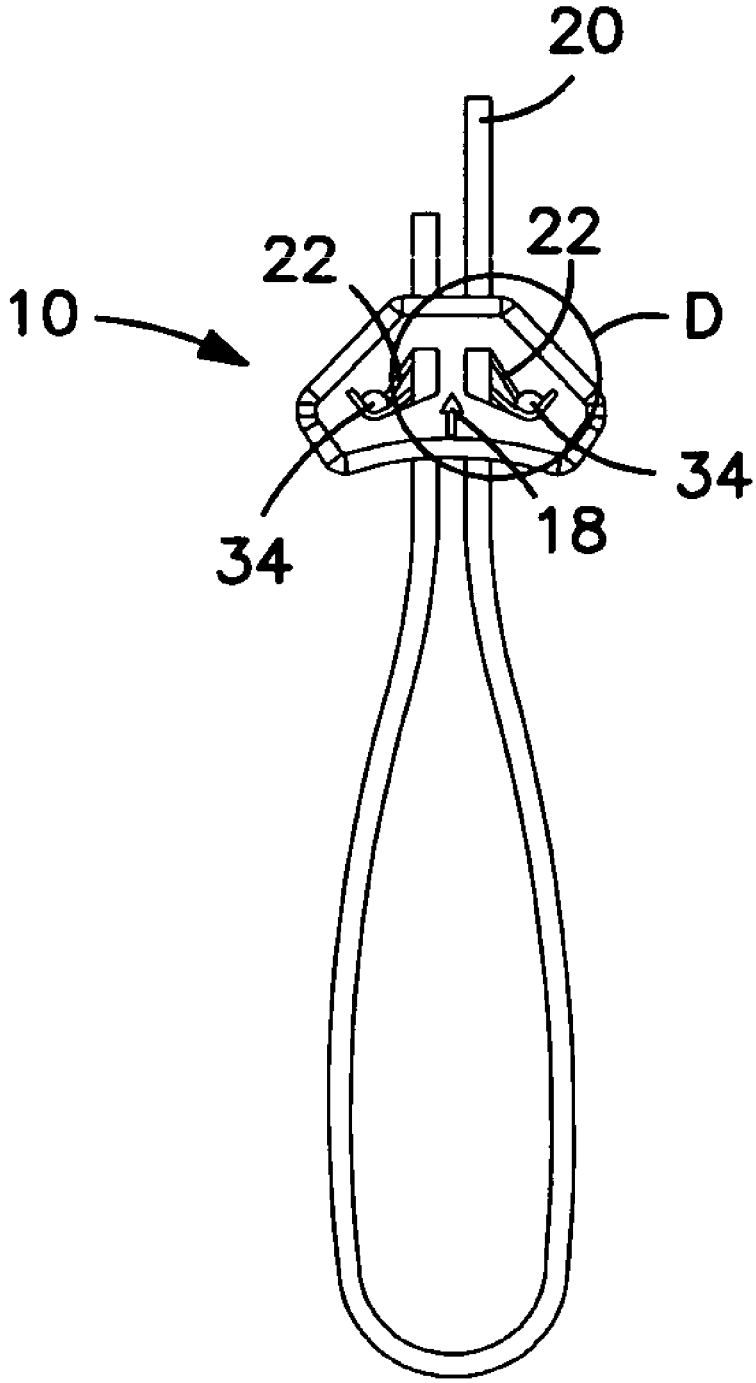
FIG. 2 is a side view showing the locking head with use of the strap.
Figure 4:
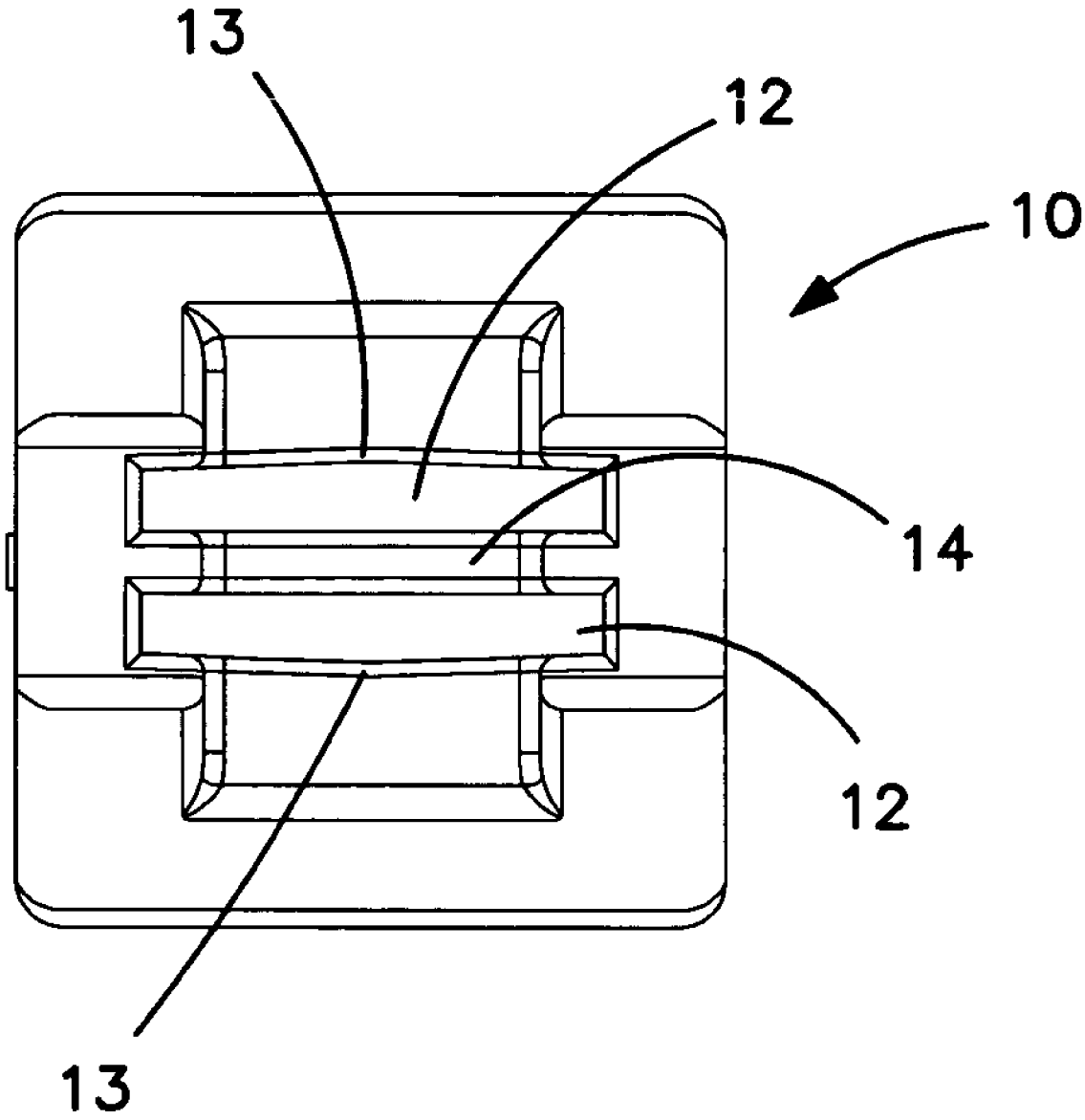
FIG. 4 is a top view of the locking head of the present invention.

As shown in FIG. 1, the locking head 10 has two vertical apertures 12 which are separated by the central dividing wall 14. Two transverse pawl cavities 16 extend the width of the locking head 10. The transverse pawl cavities 16 generally comprise a wedge-shaped design. FIGS. 1 and 2 indicate an arrow 18 on the side of the locking head that illustrates the unidirectional insertion direction of the planar strap 20. FIG. 4 illustrates a top view of the locking head 10 indicating the two vertical apertures 12 separated by the central dividing wall 14. The vertical apertures 12 can have a radius edge 13 at the top and bottom of the locking head 10 that can ease the insertion and movement of the planar strap 20 through the locking head 10.

The two separate transverse pawl cavities 16 within the locking head 10 provide a narrow anchor point for retaining the two flexible pawls 22. In addition to the narrow anchor point, the wedge-shaped cavities provide a wider space for flexible movement of the pawls 22 during insertion and locking engagement with the planar strap 20. Each pawl 22 is L-shaped with a mounting end 44, the short end of the L, and the engagement end 42. The engagement end 42 comprises two or more pointed teeth 48 that are substantially free of bevel. The angle of the teeth can vary depending upon the locking engagement desired and the strap material. Generally, the angle of the teeth can be between 60 to 120 degrees. A 90-degree tooth configuration A has been found to be particularly effective in locking engagement with the planar strap 20. While a series of equal 90-degree teeth has proved effective, the present invention can also include the use of varying teeth angles. For example, a smaller angled tooth can be interspersed among the 90-degree teeth to provide additional bite into the strap.

The pawls 22 can be made of any suitable material. The material should provide sufficient flex of the pawl 22 during insertion and engagement with the planar strap. Metal provides an ideal solution with the specific composition dependent on the specific use and the desired longevity of the locking head. Preferred choices include a wide variety stainless steel compositions, bronze or aluminum. As the locking heads are often used outdoors, corrosion resistance is a consideration in selecting the appropriate material for the pawls 22. The size and thickness of the pawls 22 will vary depending upon the size of the locking head and the planar strap. For many applications, a pawl with a thickness of 0.012 to 0.020 inch has performed satisfactorily with a preferred thickness of 0.015. Likewise, the dimensions of the pawl 22 and the configuration of the pawl 22 within the locking head will vary with the application. A preferred angle of the pawl 22 was found to be 100 degrees while the angle beneath the pawl between 15 and 35 degrees. The preferred angle beneath the floor 6 of the pawl cavity and horizontal was 20 degrees.

Figure 3:
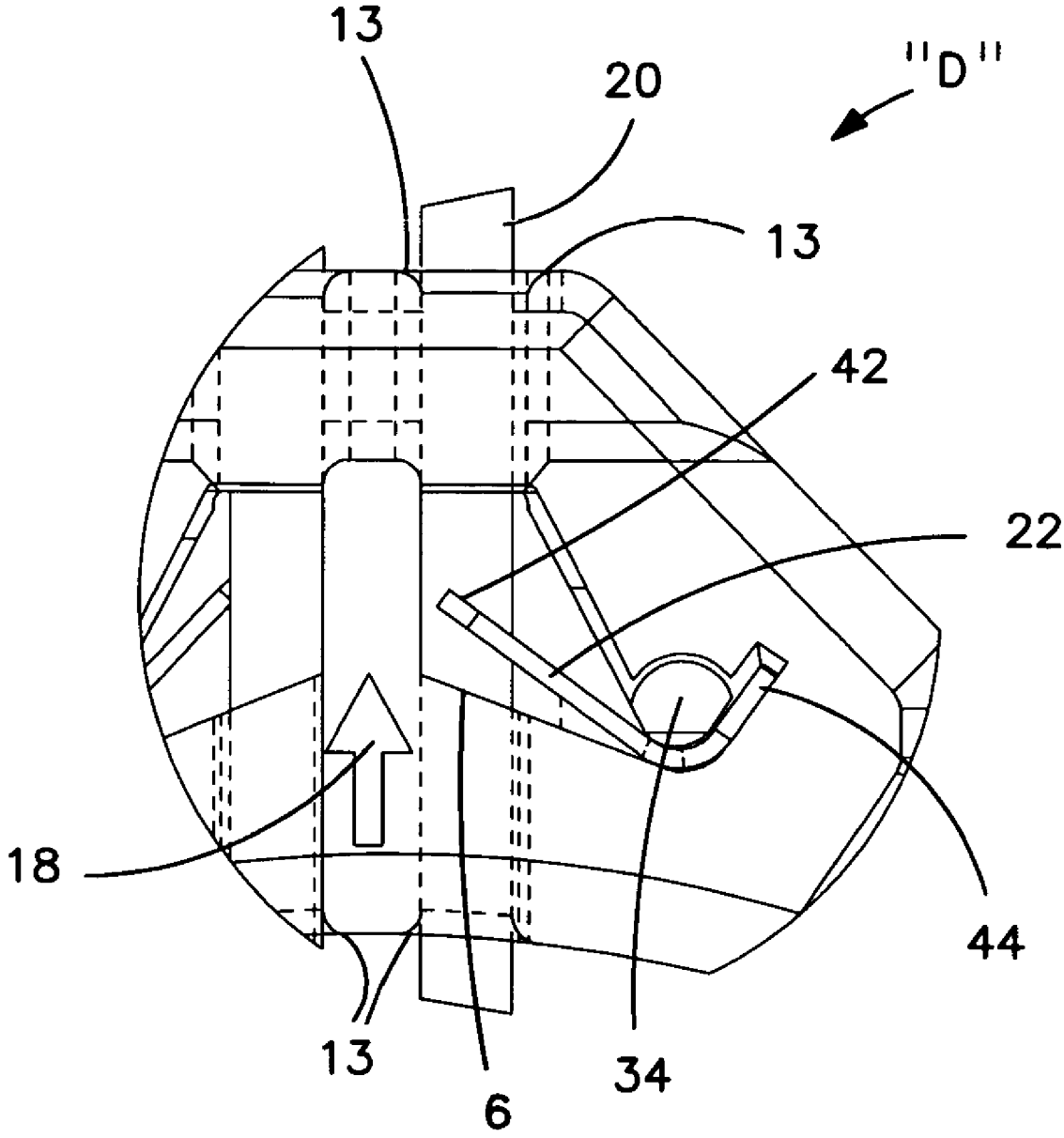
FIG. 3 is blown up view of section D of FIG. 2.

As indicated in FIGS. 2 and 3, once installed in the locking head 10, the engagement ends of the pawls 42 partially extend into the respective vertical apertures 12 5 for locking engagement with the smooth planar strap 20. The width of the pawl can vary but is preferably less than the width of the planar strap. For example, a 0.500 inch wide planar strap can be equipped with a 0.360 width pawl. By using a pawl with a width less than the width of the strap, the danger of cutting completely through the strap during excessive loading is diminished or eliminated.

Figure 6A:
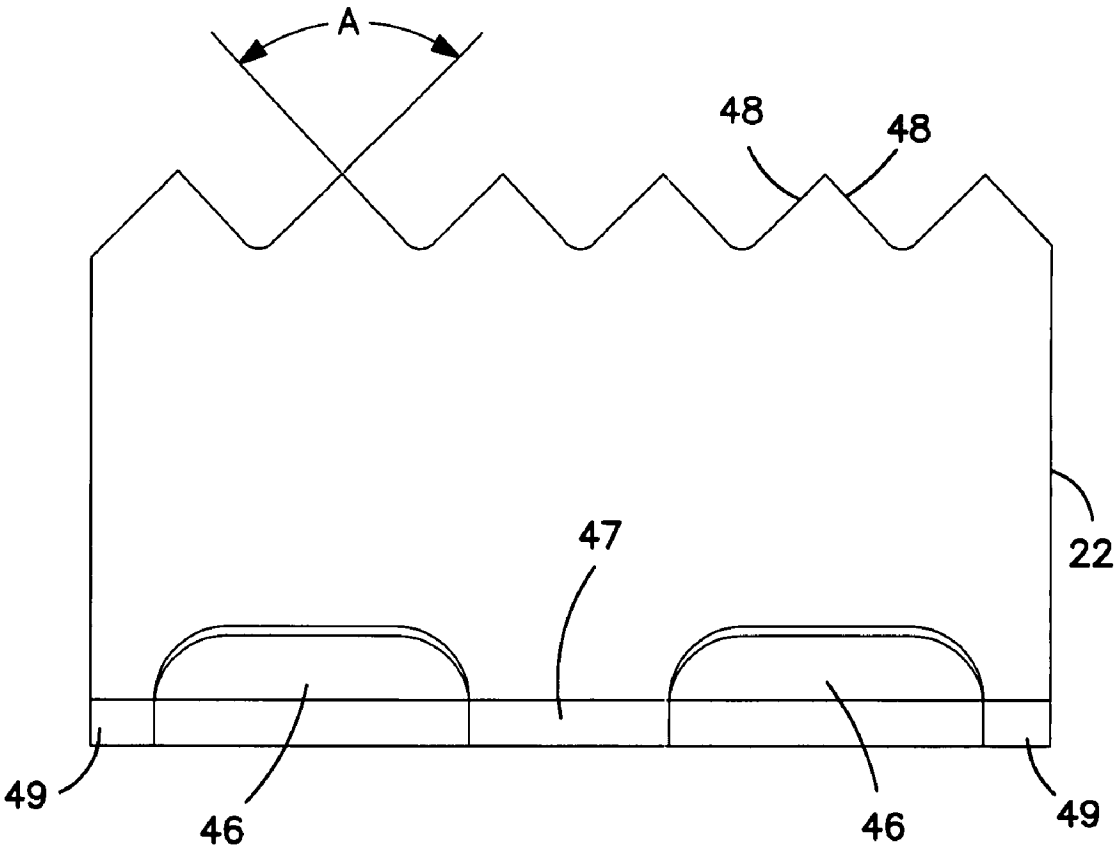
FIG. 6A is a side view of the pawl.
Figure 6B:
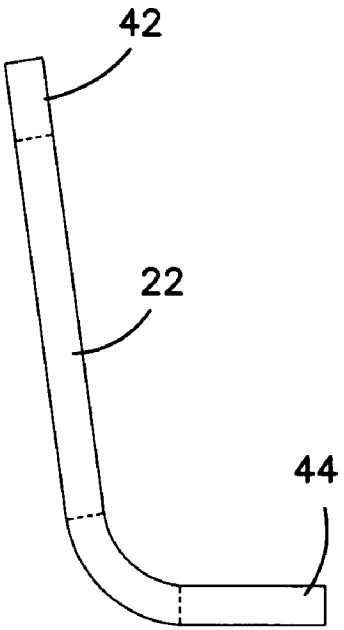
FIG. 6B is an end view of the pawl.

As shown in FIG. 6A, the mounting end of the pawl 44 can include one or more cutouts 46 at the planar vertex that allow the pawl to flex. The size and number of cutouts can vary depending upon the desired flex of the pawl. The greater the amount of material cutout offers greater flex of the pawl. Care must be taken so as not to remove too much material and thus destroy the integrity of the pawl. A preferred configuration includes a solid central portion of the planar vertex 47 and solid edges 49 surrounding the cutouts 46. This design provides adequate flex of the pawl 22 without compromising the integrity of the pawl 22. The solid edges 49 also provide a secure insertion surface for guiding the pawl into the locking tie head 10.

Figure 5:
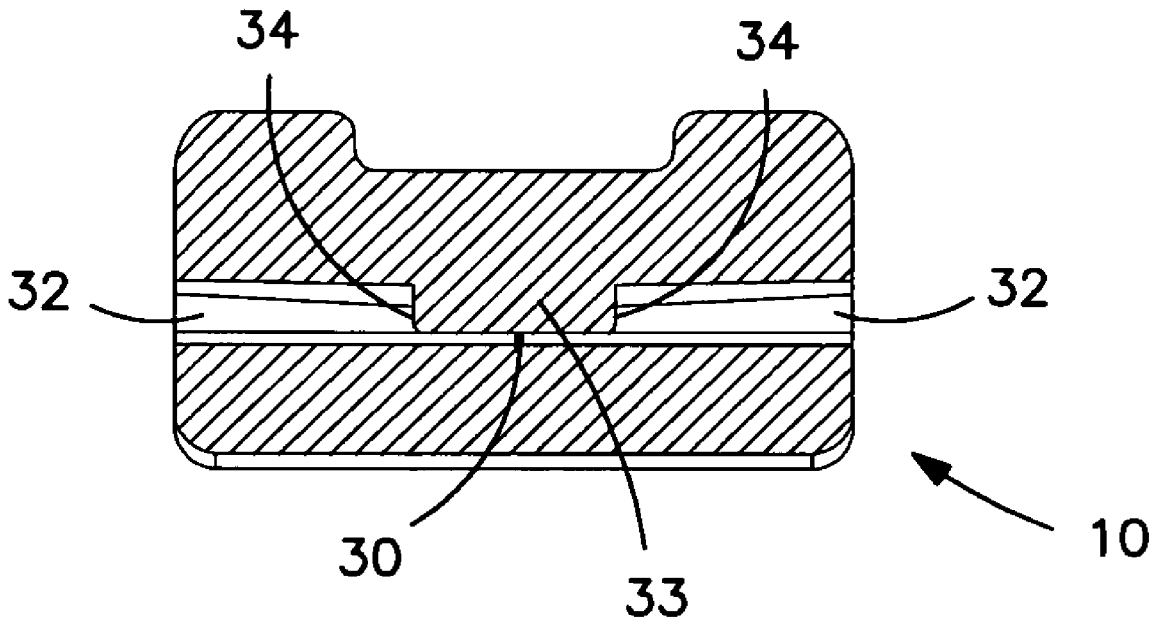
FIG. 5 is a cross section of locking head illustrating the pawl anchor point and the pinch point.

As shown in FIGS. 2 and 3, the pawl 22 is inserted through a narrow channel 32 of the transverse pawl cavity 16. FIG. 5 illustrates a cross section of the locking head 10 with the narrow insertion channel 32 on either side of the vertical column 33. The vertical column 33 provides an interference fit with the mounting end of the pawl 44.

The column 33 has opposing ends 34, shown head on in FIG. 5 and from the side in FIG. 3. The opposing ends 34 provide a pin push stop while inserting the pawl 22 into the narrow channel 32 of the locking head 10. At the midpoint of the narrow channel 32 and vertical column 33, a breakaway pin 30 provides a pinch point for further anchoring the pawl 22. The breakaway pin 30 secures the solid portion of planar vertex 47 of the pawl 22. After insertion of the pawl 22, the solid edges 49 of the pawl 22 anchor flush with the opposing ends 34 of the vertical column 33.

The smooth planar strap can be prepared from a wide variety of thermoplastic materials including polyamides, polyesters, polyacetals and copolyetheresters. A preferred material is oriented acetal. Typically, such materials are produced in strap form, oriented, and then cut to the desirable length and shape. Preferred materials should be strong and flexible and able to withstand the elements as the bundling system of the present invention is often employed outdoors. While bundling systems can include one-piece construction with the strapping material molded to the tie head, a preferred system includes a two-piece construction. With a separate locking tie head, various strapping materials and lengths of strapping can be used depending upon the desired use.

With the pawls 22 installed in the locking head, the planar strap 20 is then cut to the appropriate length. The first end of the planar strap is inserted in a first aperture of the locking head. The strap makes contact with the central dividing wall and hits the toothed end of the pawl. Although the pawl partially extends into the aperture, the transverse pawl cavity allows the deflection of the pawl in the same direction of the insertion of the strap into the locking head. As soon as tension is placed on the strap in the opposite direction of insertion, the teeth of the pawl engage with the strap. As tension increases, the pawl flexes and further engages the strap. The greater the tension on the strap, the greater the pawl engages with the strap.

The second end of the strap can then be wrapped around the articles to be bundled. The second end of the planar strap can then be inserted into the second aperture of the locking head. Again, the two pawls independently flex as the strap is pulled through the apertures. As the strap tightens around the bundled articles, the excess strapping material extends beyond the locking head and can be removed by cutting the strap. The toothed ends of the pawls lockingly engage with the strap and prevent withdrawal of the strap.

This description and the Figures illustrate one example of the present invention and are in no way meant to be limiting. Several different specific designs are contemplated by the inventors without parting from the original spirit and scope of the present invention and would be easily recognizable by those skilled in the art. Whereas the invention has been shown and described in connection with the preferred embodiments thereof, it will be understood that many modifications, substitutions and additions can be made which are within the intended broad scope of the following claims.

We claim:

1. A bundling tie system comprising:

(a) a separate smooth planar strap having a first end and a second end;

(b) a locking tie head having a first aperture and a second aperture with an inlet and an outlet for unidirectional insertion of the first and second strap ends, a central dividing wall between the first and second apertures, and a first and second pawl cavity transverse to the first and second apertures; and (c) first and second independent flexible L-shaped pawls having planar vertex and a first angle created at the planar vertex by intersection of a first leg and a second leg, wherein the pawls are anchored in the first and second transverse pawl cavity, with the first leg having a mounting end and the second leg having an engagement end, with the mounting end fixedly anchored in the locking head, and the engagement end having two or more teeth, partially extending into the first and second aperture for locking engagement with the planar strap;

wherein the transverse pawl cavities allow flexural movement of the engagement end of the pawl at the planar vertex thereby changing the angle of the pawl during the insertion of the planar strap and then locking engagement to prevent withdrawal of the strap.

2. The bundling tie system of claim 1 wherein the transverse pawl cavities are substantially wedge-shaped with a tapered first end and a second end wider than the first end, and wherein the first end of the pawl is anchored at the tapered end.

3. The bundling tie system of claim 1 wherein the pawl teeth have substantially flat edges and are substantially free of bevel.

4. The bundling tie system of claim 3 wherein the pawl teeth are pointed.

5. The bundling tie system of claim 4 wherein the pawl teeth form an angle of 90 degrees.

6. The bundling tie system of claim 5 wherein the pawl teeth are along the entire width of the pawl.

7. The bundling tie system of claim 1 wherein the pawls are metal.

8. The bundling tie system of claim 7 wherein the metal is stainless steel.

9. The bundling tie system of claim 1 wherein the first and second pawls have one or more cutouts at the planar vertex to allow the pawls to flex.

10. The bundling tie system of claim 9 wherein the first and second pawls have solid edges and a solid central portion surrounding the cutouts.

11. The bundling tie system of claim 1 wherein the pawl width is less than the width of the strap.

12. The bundling tie system of claim 1 wherein the strap consists essentially of acetal.

13. The bundling tie system of claim 12 wherein the strap is oriented material.

14. The bundling tie system of claim 1 wherein the strap consists essentially of nylon.

15. The bundling tie system of claim 1 wherein the locking head further comprises a vertical column in the first and second transverse pawl cavity for providing a pushpin stop.

16. The bundling tie system of claim 1 wherein the locking head further comprises one or more breakaway pins for anchoring the first and second pawls.

17. The bundling tie system of claim 1 with rounded corners.

* * * * *